US005947241A

United States Patent [19]

Rausch

[11] Patent Number: 5,947,241

[45] Date of Patent: Sep. 7, 1999

[54] JOINABLE, SOFT-SIDED CONTAINERS

[75] Inventor: Kevin Rausch, Wooster, Ohio

[73] Assignee: Rubbermaid Incorporated, Wooster, Ohio

[21] Appl. No.: 08/863,958

[22] Filed: May 27, 1997

[51] Int. Cl.[6] ..... A45C 13/10; A45C 13/26

[52] U.S. Cl. ..... 190/108; 190/102; 190/110; 190/115; 150/111

[58] Field of Search ..... 190/108, 110, 190/102; 150/111; 383/37; 224/42.11, 430, 431

[56] References Cited

U.S. PATENT DOCUMENTS

| | | | |
|---|---|---|---|
| D. 227,818 | 7/1973 | Dipadova | 190/108 X |
| 340,339 | 4/1886 | Marshall | 224/42.11 X |
| 424,324 | 3/1890 | Marshall | 224/42.11 X |
| 2,574,786 | 11/1951 | Hiatt | 190/110 X |
| 2,707,035 | 4/1955 | Lashley | 190/108 X |
| 2,813,602 | 11/1957 | MacArthur, Jr. | 190/108 X |
| 2,844,179 | 7/1958 | Koret | 150/111 |
| 2,979,098 | 4/1961 | Greaves | 383/37 X |
| 3,122,225 | 2/1964 | Ward | 190/108 |
| 3,339,824 | 9/1967 | Luke | 383/37 X |
| 3,729,038 | 4/1973 | Ekeson | 190/110 |
| 3,786,972 | 1/1974 | Alley | 224/430 X |
| 3,837,447 | 9/1974 | Honan | 190/108 X |
| 3,937,374 | 2/1976 | Hine, Jr. | 224/430 |
| 4,955,516 | 9/1990 | Satterfield | 383/37 X |
| 4,995,436 | 2/1991 | Cantor | 150/111 X |
| 5,050,713 | 9/1991 | Lee | 190/108 |
| 5,509,515 | 4/1996 | Guo | 150/111 X |
| 5,520,462 | 5/1996 | Clark | 383/37 |

FOREIGN PATENT DOCUMENTS

| | | | |
|---|---|---|---|
| 2342895 | 3/1975 | Germany | 190/110 |
| 3600794 | 8/1986 | Germany | 190/110 |
| 69365 | 1/1952 | Netherlands | 224/42.11 |

*Primary Examiner*—Sue A. Weaver
*Attorney, Agent, or Firm*—Renner, Kenner, Greive, Bobak, Taylor & Weber

[57] ABSTRACT

Joinable, soft-sided containers (10) include individual containers (12, 14) each having a compartment (20, 22). Individual containers (12, 14) have handle portions (16, 18) extending outwardly therefrom which each include, in turn, a first panel (50, 52) and a second panel (54, 56). Each first panel (50, 52) has an opening (60, 62) therein that may serve as a handle when the individual containers (12, 14) are used individually. The containers (12, 14) may be configured into a saddlebag configuration by joining the second panels (54, 56) such that openings (64, 66) in the second panels (54, 56) align to form a single opening that may be placed over a handle (76) of a briefcase (74). The individual containers (12, 14) may also be configured into a single container (80) having two compartments (20, 22) by joining the rear walls (24, 26) of the containers (12, 14) and joining the first panels (50, 52) such that the opening (60, 62) in the first panels (50, 52) align and form a single handle.

8 Claims, 3 Drawing Sheets

JOINABLE, SOFT-SIDED CONTAINERS

TECHNICAL FIELD

This invention relates to containers and, more particularly, to joinable, hand-held containers having handles. Specifically, the present invention relates to hand-held containers that may be used alone, joined to form a two-compartment container or joined and carried over a briefcase, saddlebag style.

BACKGROUND ART

Soft-sided insulated bags have become popular in recent times for carrying lunches to the work place or the like. These bags are convenient because they may be easily packed and stored due to their flexibility.

A single bag is, however, often not large enough to accommodate all of the items that a person desires to pack, especially when packing more than one beverage containers such as two 12 oz. cans. As such, it is desired to provide a container having multiple compartments that provide additional packing space. Known bags that provide such compartments cannot, however, be broken down into a single bag when only a single bag is desired. Thus, a person must purchase two containers to use in different situations. It is thus desirable to provide a container that may be configured to have either one or two compartments while being separable so that only one compartment may be used if desired.

Another problem relates to the carrying of a fully packed container while also carrying a briefcase, purse, umbrella, coat and/or other articles. Although an empty container may usually be easily packed into a briefcase, a fully packed container will often not fit into a briefcase or purse. Thus, it is desirable to provide a container having a convenient method of attaching the container to a briefcase or purse so that it may be more easily carried.

DISCLOSURE OF THE INVENTION

In view of the foregoing, it is an object of the present invention to provide joinable, soft-sided containers that individually provide a single compartment but may be joined to function as a single container having two compartments.

It is another object of the present invention to provide joinable, soft-sided containers, as above, that may be joined to form a saddlebag configuration where each compartment may ride on either side of a briefcase, purse, or the like.

It is a further object of the present invention to provide joinable, soft-sided containers, as above, that may be joined to form an opening for the briefcase or purse handle when in the saddlebag configuration.

It is yet another object of the present invention to provide joinable, soft-sided containers, as above, wherein each single container also is provided with a handle.

It is still another object of the present invention to provide joinable, soft-sided containers, as above, wherein a single container may be carried on a briefcase or purse by placing the handle of the container over the briefcase or purse handle.

It is another object of the present invention to provide joinable, soft-sided containers, as above, wherein the individual container handles cooperate to function as a single handle when the individual containers are joined to form a two-compartment single container.

These and other objects of the present invention, which will become apparent from the description to follow, are accomplished by the improvements hereinafter described and claimed.

In general, joinable, soft-sided containers include first and second individual containers having a compartment therein. A handle portion extends from each of the containers and has an opening therein. The handle portion of one of the individual containers is attachable to the other handle portion of the other individual container such that the openings in the handle portions align to form a single opening.

Preferred exemplary soft-sided containers incorporating the concepts of the present invention are shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
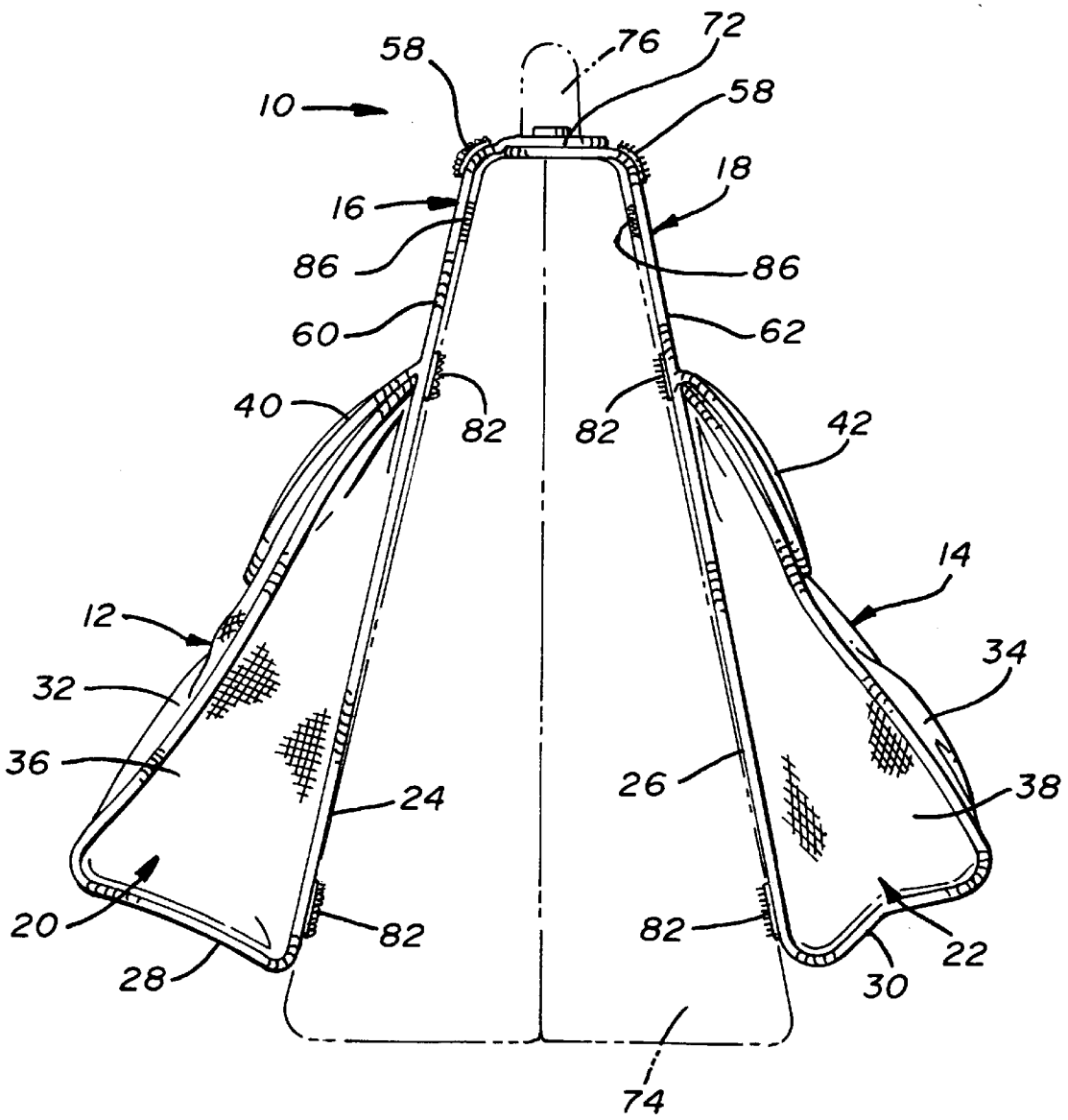
FIG. 1 is a side elevational view of the joinable, soft-sided containers made in accordance with the concepts of the present invention depicted in the saddlebag configuration and disposed over a briefcase.

Joinable, soft-sided containers made in accordance with the concepts of the present invention are indicated generally by the numeral 10 in the accompanying drawings. Joinable containers 10 include a pair of individual containers 12, 14 that may be at least joined by their extending handle portions 16, 18.

Each individual container 12, 14 includes a bag or compartment 20, 22 that is defined by a rear wall 24, 26, a bottom wall 28, 30, a front wall 32, 34, and a pair of expandable side walls 36, 38, respectively. Each bag 20, 22 is selectively closed by a flap 40, 42, respectively, that is attached to the upper portion of the rear wall 24, 26, respectively, and extends downwardly over the front wall 32, 34, respectively. Flap 40, 42 may be selectively attachable to the front wall 32, 34, respectively, by a suitable connector such as a snap or a length of VELCRO® material. Expandable side walls 36, 38 allow each compartment 20, 22 to expand to accommodate the articles placed therein. Compartments 20, 22 may be preferably fabricated from a flexible nylon material, but the present invention contemplates that compartments 20, 22 may be fabricated from any relatively flexible material. In other embodiments of the present invention, compartments 20, 22 may be formed solely from relatively rigid material or from a combination of rigid materials and flexible materials. However, when compartments 20, 22 are fabricated from flexible material, they may be pressed relatively flat when empty for easy storage.

Handle portions 16, 18 extend upwardly from the upper portions of the rear walls 24, 26, respectively, over compartments 20, 22. In some embodiments of the present invention, each handle portion 16, 18 may be integrally formed with each rear wall 24, 26.

Each handle portion 16, 18 includes a first panel 50, 52 and a second panel 54, 56, respectively. Each first panel 50, 52, includes an opening 60, 62, respectively, that cooperates with first panel 50, 52, respectively, to function as a handle when individual containers 12, 14 are used on their own. Openings 60, 62 may also be used to support individual containers 12, 14 by placing a panel 50 or 52 over a handle on a briefcase or a purse such that the handle of the briefcase or the purse protrudes through opening 60 or 62 to secure individual container 12 or 14 thereto. Opening 60 or 62 may also be used to hang individual containers 12 or 14 on a hook or a doorknob. When first panel 50, 52 is used in this manner, second panel 54, 56 may be folded back over first panel 50, 52, respectively, so that it does not interfere with the use of first panel 50, 52. To maintain its folded position, panels 54, 56 may be provided with suitable connectors 58 in the nature of snaps or strips of VELCRO® material that serve to connect second panels 54, 56 to first panels 50, 52, respectively. Furthermore, the joints between panels 50, 54 and 52, 56 are designed to be flexible to accommodate folding.

Figure 4:
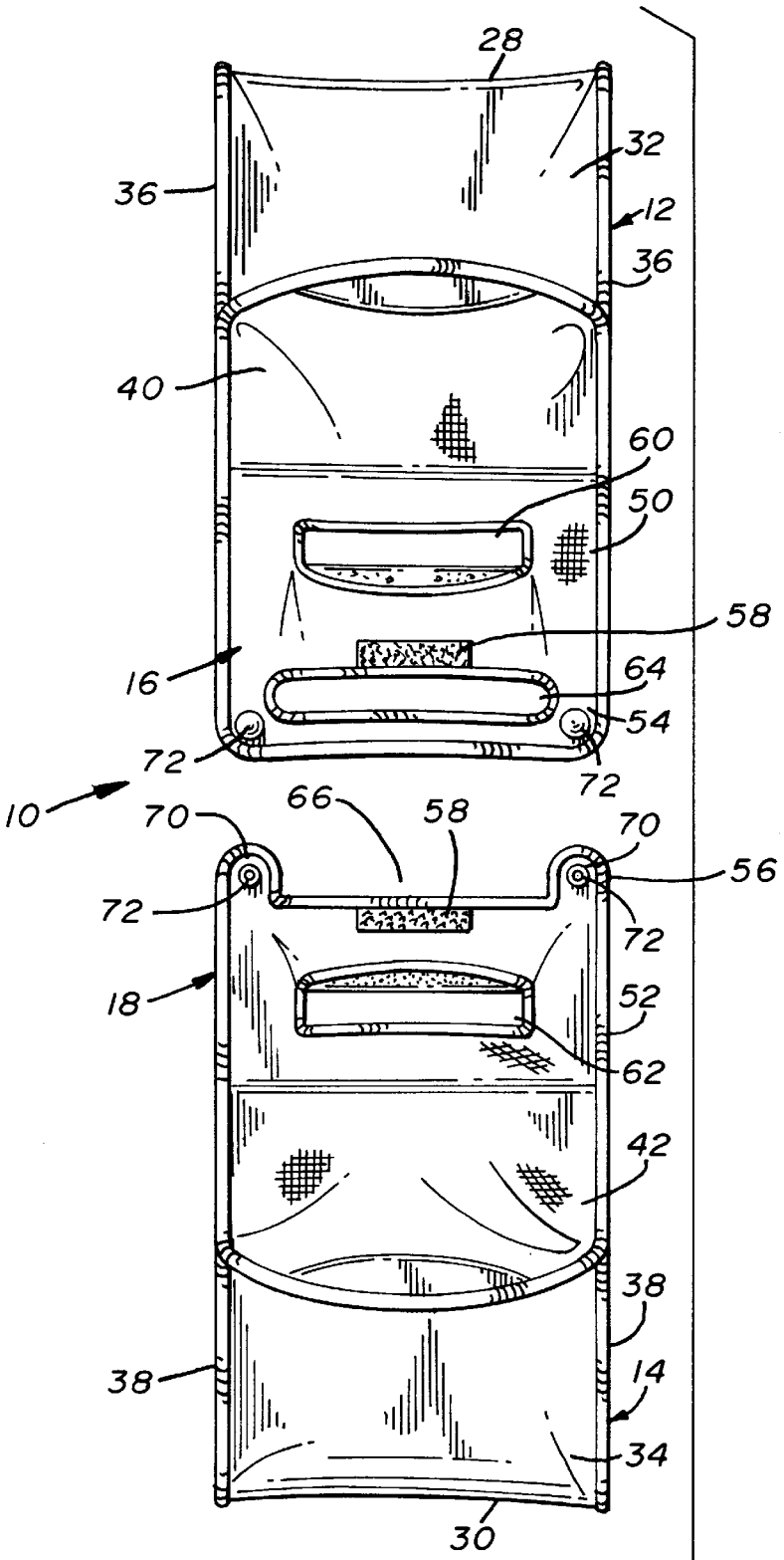
FIG. 4 is a top plan view of the containers depicting both containers in an unjoined state.

As may be perhaps best seen in FIG. 4, second panels 54, 56 also includes openings 64, 66, respectively, therein. Openings 64, 66 are configured to align with openings 60, 62, respectively, in first panels 50, 52, respectively, when second panels 54, 56 are folded back onto first panels 50, 52, respectively. As such, second panels 54, 56 do not interfere with openings 60, 62 when openings 60, 62 are being used as handles.

Figure 2:
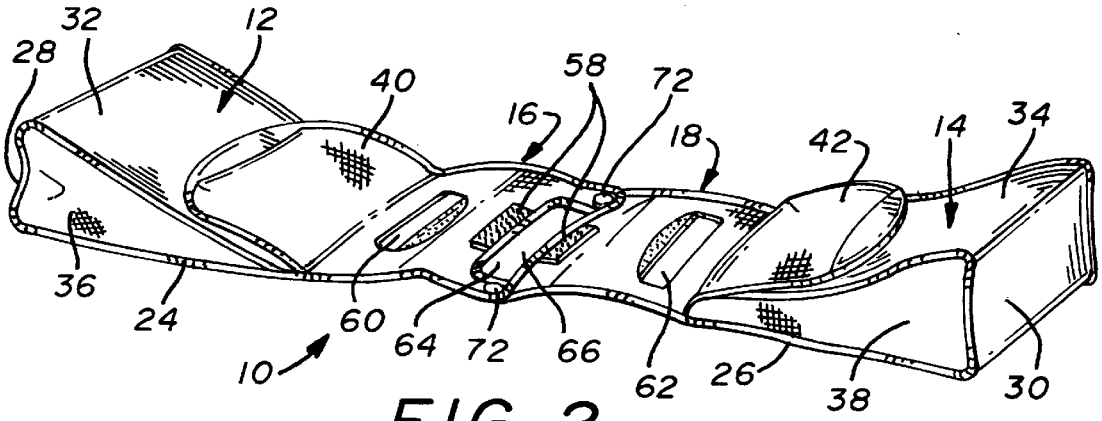
FIG. 2 is a perspective view of the joinable containers depicted in a saddlebag configuration.

One of openings 64, 66 may be configured as an opening that is entirely surrounded by material as is depicted in FIG. 4 with respect to second panel 54 and opening 64 therein. In another configuration, the opening in the second panel may be an opening 66 that is not entirely surrounded by material but rather forms a pair of tabs 70 that extend along each side of opening 66. Tabs 70 are configured to align with those portions of second panel 54 adjacent opening 64 such that opening 66 is aligned with opening 64 when second panel 56 is placed over second panel 54 as shown in FIG. 2.

Second panels 54, 56 include appropriate connectors 72 that may be typical snaps or small strips of VELCRO® material. Connectors 72 allow second panels 54, 56 to be securely connected causing individual containers 12, 14 to be configured in a saddlebag configuration as depicted in FIG. 2. When in this configuration, joinable containers 10 may be placed on either side of a briefcase 74 with the handle 76 of briefcase 74 protruding through openings 64, 66. Connectors 72 are strong enough to maintain their connection between second panel 54 and second panel 56 even when both bags 20, 22 are fully loaded.

Figure 3:
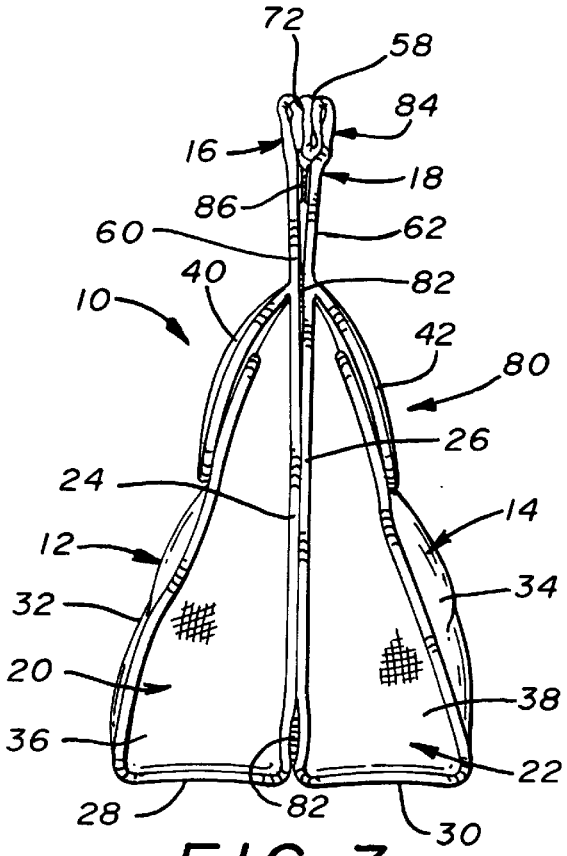
FIG. 3 is a side elevational view of the joinable containers in a joined configuration in which the containers are joined to function as a single container having two compartments.

Joinable containers 10 may also be configured into a single container 80 having a pair of compartments 20, 22 as depicted in FIG. 3. To achieve this configuration, rear walls 24, 26 of individual containers 12, 14 are connected to each other by way of suitable connectors 82 that are attached to rear walls 24, 26 of containers 12, 14. Connectors 82 may preferably be fabricated from strips of VELCRO® material, but may also be any suitable connector known in the art. To form a single handle 84 for this configuration, first panels 50, 52 are also joined by a suitable connector 86 such that opening 60 aligns with opening 62 to form handle 84. In this configuration, second panels 54, 56 are connected by connectors 72 but are folded such that they do not protrude into openings 60, 62. Thus, it can be understood that two individual containers 12, 14 may be joined to form single container 80 having a pair of compartments 20, 22 with single handle 84.

It should thus be evident that joinable, soft-sided containers 10 made in accordance with the present invention provide containers that may be individually used with their own handle or may be joined into a saddlebag configuration that may be placed over a briefcase or purse. Joinable, soft-sided containers 10 thus accomplish the objects of the present invention and otherwise substantially improve the art.

I claim:

1. Joinable, soft-sided containers, for use with a briefcase having a handle, comprising first and second individual containers having a compartment therein, a handle portion extending from each of said containers, each of said handle portions having a handle opening of a configuration so that said containers can be carried individually, said handle portion of one of said individual containers being attachable to said other handle portion of said other individual container in a first configuration such that said handle openings in said handle portions are aligned adjacent to each other to form a single handle opening of said first configuration, each of said handle portions also having a second opening, said handle portions being attachable in a second configuration such that said second openings in said handle portions are aligned adjacent to each other to form a saddlebag opening wherein said individual containers are disposed on opposite sides of the briefcase with the handle of the briefcase protruding through said saddlebag opening of said joined containers joined in said second configuration.

2. Joinable, soft-sided containers according to claim 1 wherein said individual containers have a rear wall, said rear walls carrying connectors being attachable by said connectors, said handle portions being attached in said first configuration such that said single opening formed by said handle portions functions as a single handle for both individual containers.

3. Joinable, soft-sided containers comprising first and second individual containers having a compartment therein, a handle portion extending from each of said containers, wherein each of said handle portions has a first panel and a second panel, each of said first panels providing a handle opening so that said containers can be carried individually, said handle portion of one of said individual containers being attachable to said other handle portion of said other individual container in a first configuration such that said handle openings in said handle portions are aligned adjacent to each other to form a single handle opening of said first configuration, and each of said second panels providing a second opening.

4. Joinable, soft-sided containers according to claim 3 wherein said first panels of said handle portions are provided with connectors so that said first panels may be joined in said first configuration such that said handle openings in said first panels align to form said single handle opening.

5. Joinable, soft-sided containers according to claim 3, wherein said second panels of said handle portions are provided with connectors so that said handle portions may be joined in a second configuration such that said second openings in said second panels align to form a saddlebag opening such that the joinable, soft-sided containers may be carried in a saddlebag fashion over the handle of a briefcase.

6. Joinable, soft-sided containers according to claim 5, further comprising a pair of tabs extending from one of said second panels, said tabs extending on each side of said second opening.

7. Joinable, soft-sided containers according to claim 6 wherein said tabs are provided with said connectors so that said tabs may be attached to said connectors formed on the other of said second panel to connect said handle portions in said second configuration to align said second openings in said second panels to form said saddlebag opening.

8. Joinable, soft-sided containers comprising first and second individual containers having a compartment therein, a handle portion extending from each of said containers, each of said handle portions having a first panel and a second panel, each of said panels having an opening, said handle portion of one of said individual container attachable to said other handle portion of said other individual container such that said openings in said first panels align to form a single opening, said second panels having connectors so that said second panels can be folded so as not to obstruct said single opening.

* * * * *